US009272763B2

(12) United States Patent
Troester et al.

(10) Patent No.: US 9,272,763 B2
(45) Date of Patent: Mar. 1, 2016

(54) LOW WATER LIFT ASSEMBLY

(71) Applicants: Jeffrey Allan Troester, Granger, IN (US); Thomas Franklin Troester, Granger, IN (US)

(72) Inventors: Jeffrey Allan Troester, Granger, IN (US); Thomas Franklin Troester, Granger, IN (US)

( * ) Notice: Subject to any disclaimer, the term of this patent is extended or adjusted under 35 U.S.C. 154(b) by 27 days.

(21) Appl. No.: 14/297,776

(22) Filed: Jun. 6, 2014

(65) Prior Publication Data

US 2015/0353173 A1 Dec. 10, 2015

(51) Int. Cl.
*B63C 3/06* (2006.01)

(52) U.S. Cl.
CPC ..... *B63C 3/06* (2013.01)

(58) Field of Classification Search
USPC ..... 405/1, 3, 4, 86; 248/149, 161, 157, 248/125.1
See application file for complete search history.

(56) References Cited

U.S. PATENT DOCUMENTS

| | | | | |
|---|---|---|---|---|
| 3,402,828 A * | 9/1968 | Vilter | B63C 3/06 | 254/2 R |
| 4,595,313 A * | 6/1986 | Kotke | B63C 3/06 | 187/200 |
| 4,641,596 A * | 2/1987 | Reprogle | B66F 7/04 | 114/365 |
| 2012/0114417 A1 * | 5/2012 | Rosenberg | B63C 15/00 | 405/3 |

* cited by examiner

*Primary Examiner* — Sean Andrish

(57) ABSTRACT

A watercraft lift assembly is provided. The watercraft lift assembly may include a frame, a pair of opposing cantilever arm assemblies and a lifting system. The frame may include a plurality of vertical posts and overhead elements forming a generally simple cubic lattice frame defining a watercraft operational envelope. Each cantilever arm assembly may include a pair of cooperating cantilever arms. Each cantilever arm may be generally L-shaped having a horizontal arm portion and a vertical arm portion slidably secured to an adjacent vertical post. Each horizontal arm portion may include a housing for slidably receiving an extension element. On each cantilever arm assembly, a cantilever bunk may be pivotably connected to the ends of the cooperating extension elements so as to operably engage the bottom surface of various watercrafts when the pair of cantilever arm assemblies moves from a low position to a raised position under the power of the lifting system.

7 Claims, 4 Drawing Sheets

LOW WATER LIFT ASSEMBLY

BACKGROUND OF THE INVENTION

The present invention relates to watercraft lift assemblies and, more particularly, to a low water watercraft lift assembly.

Current vertical watercraft lifts utilize a beam and platform configuration. This is comprised of two horizontal beams spanning the width of the lift and additional beams spanning the length of the lift to create the platform. The watercraft resting beams (bunks) are attached above the horizontally spanning beams. This reduces the effective usability of the lift, by requiring increased water depth for operation, and as a result the current lifts cannot be utilized at the minimum manufacturer-rated water depth of many watercrafts. This is becoming an increasingly witnessed limitation as watercraft are increasing in hull volume (deeper V-Hulls) and utilizing more frequently hardware such as bottom rudders and inboard and inboards with V-Drives. During low water operations, watercrafts are either immobile or undergo large wear on the hulls as the watercraft is dragged across the bunks due to the watercrafts not being completely buoyed.

Current watercraft lifts that the platform configuration to support the bunks, limit the depth of operation by the thickness of the platform, plus any hardware used to attach the bunks.

As can be seen, there is a need for a watercraft lift assembly adapted without a platform so that it may be used in the minimum rated water depth for the lifted watercraft.

SUMMARY OF THE INVENTION

In one aspect of the present invention, a watercraft lift assembly comprises: a frame including: a plurality of vertical posts, wherein each vertical post has an upper end and a lower end; a plurality of overhead elements extending between and connecting the plurality of upper ends; and a plurality of tension elements extending between and connecting the plurality of lower ends; a left cantilever arm assembly and an opposing right cantilever arm assembly, wherein each cantilever arm assembly includes a first cantilever arm and a parallel second cantilever arm, wherein each cantilever arm comprises: a horizontal cantilever arm portion forming a horizontal housing, wherein the horizontal housing slidably receives an extension element; a vertical cantilever arm portion perpendicularly joined to the horizontal cantilever arm portion, wherein the vertical cantilever arm portion forms a vertical housing slidably receiving an adjacent vertical post, wherein the vertical housing may include at least one roller rotably coupled to the adjacent vertical post; and a cantilever bunk pivotably connected to the ends of the extension elements of the first cantilever arm and the parallel second cantilever arm; and a lifting system comprising: a cable sheave connected to a lift-cabled vertical post; a cable or winch box connected to the lift-cabled vertical post; a lifting cable affixed to the vertical housing of the first cantilever arm of the cantilever arm assembly and extending upwardly to an adjacent overhead element and through a series of cable sheaves so as to extend horizontally across the adjacent overheard element and then vertically down through the cable box and the vertical housing of the first cantilever arm of the right cantilever arm assembly and to and under the cable sheave, wherein the cable box is configured to engage the lifting cable so as to provide lifting power.

These and other features, aspects and advantages of the present invention will become better understood with reference to the following drawings, description and claims.

DETAILED DESCRIPTION OF THE INVENTION

Figure 1:
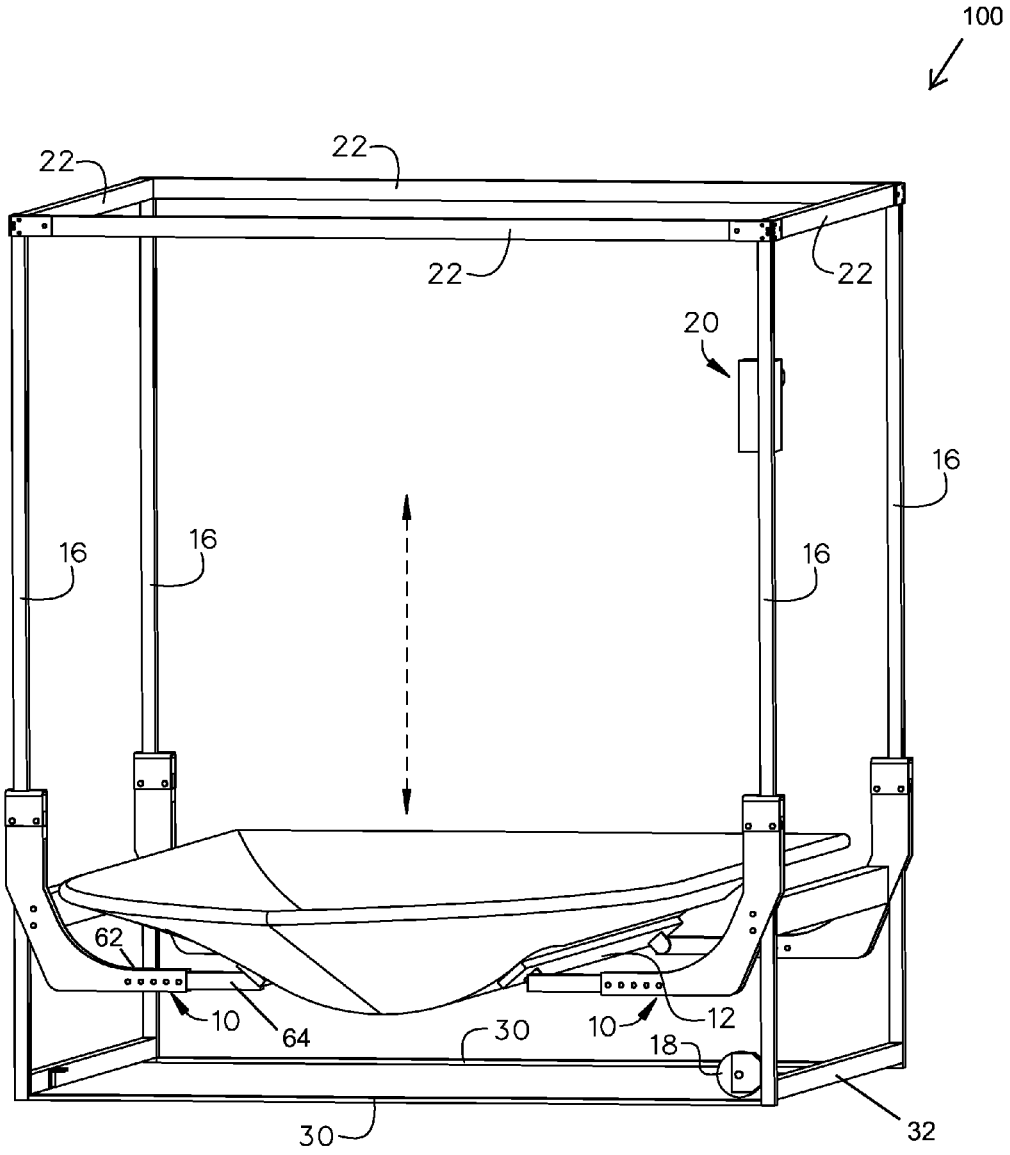
FIG. 1 is a front perspective view of an exemplary embodiment of the present invention in a low position.
Figure 2:
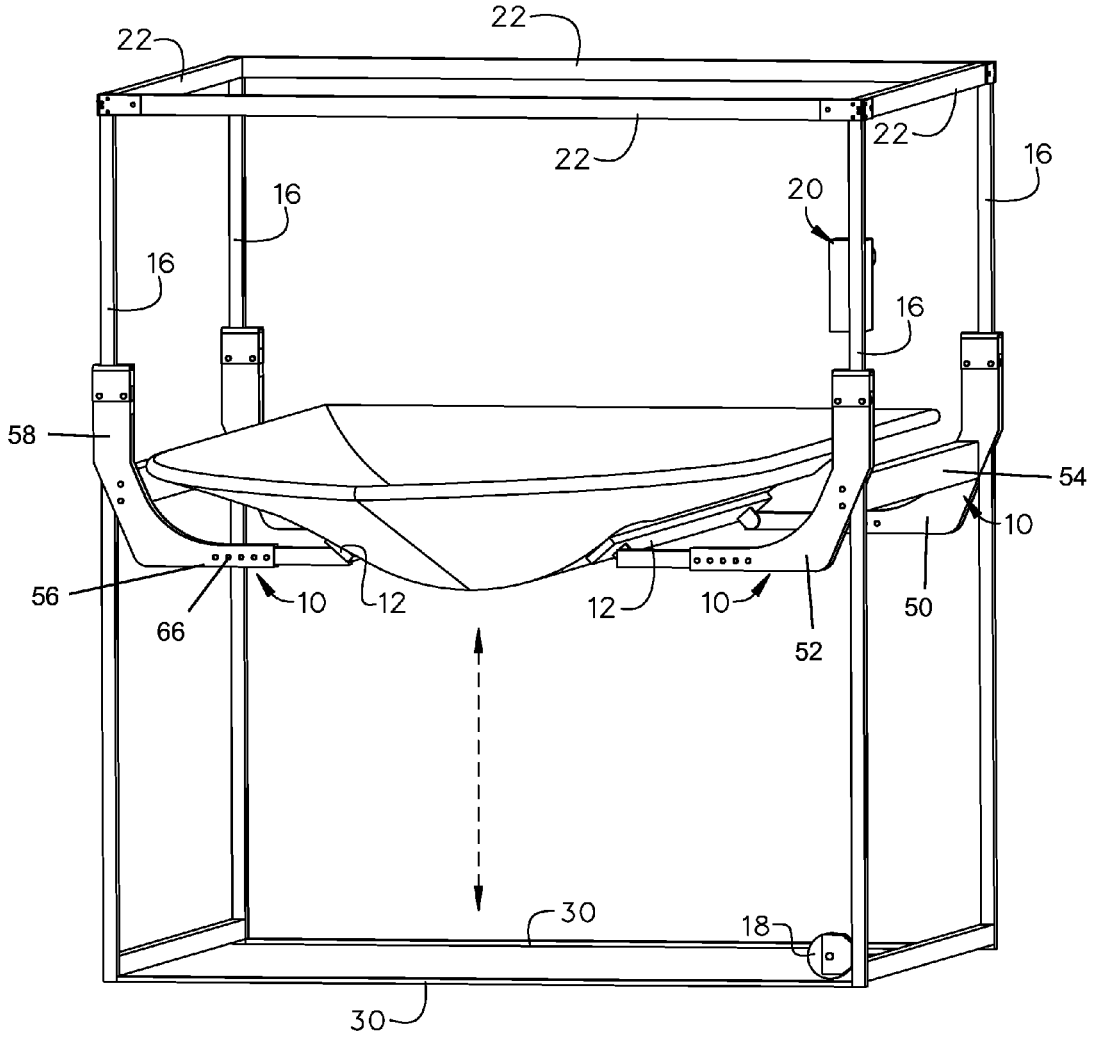
FIG. 2 is a front perspective view of an exemplary embodiment of the present invention in a raised position.
Figure 3:
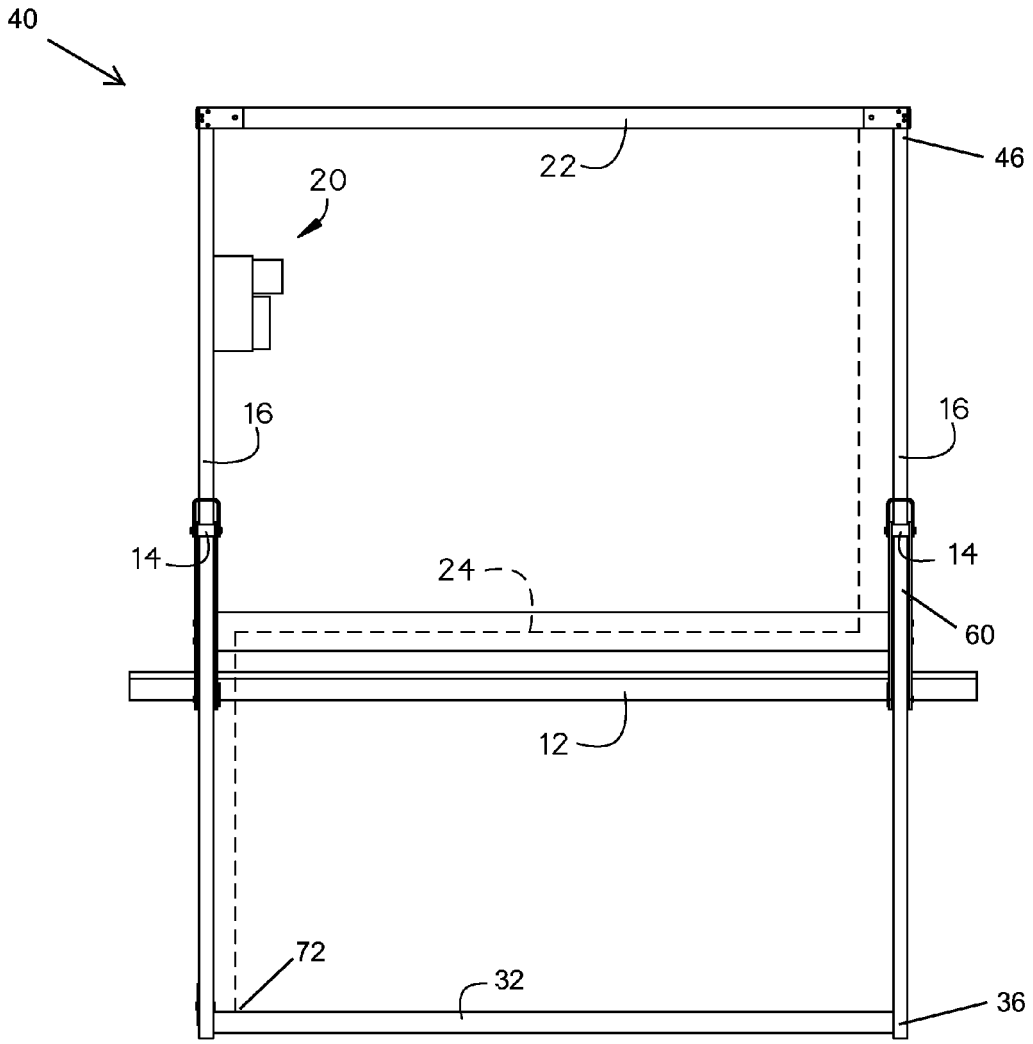
FIG. 3 is a side view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a watercraft lift assembly. The watercraft lift assembly may include a frame, a pair of opposing cantilever arm assemblies and a lifting system. The frame may include a plurality of vertical posts and overhead elements forming a generally simple cubic lattice frame defining a watercraft operational envelope. Each cantilever arm assembly may include a pair of cooperating cantilever arms. Each cantilever arm may be generally L-shaped having a horizontal arm portion and a vertical arm portion slidably secured to an adjacent vertical post. Each horizontal arm portion may include a housing for slidably receiving an extension element. On each cantilever arm assembly, a cantilever bunk may be pivotably connected to the ends of the cooperating extension elements so as to operably engage the bottom surface of various watercrafts when the pair of cantilever arm assemblies moves from a low position to a raised position under the power of the lifting system.

Referring to FIGS. 1 through 4, the present invention may include a watercraft lift assembly 100. The watercraft lift assembly 100 may include a frame 40, a pair of opposing cantilever arm assemblies 10, a pair of leveling cables 24 and a lifting system 70.

The frame 40 may include a plurality of vertical posts 16, a plurality of horizontal elements, including a plurality of overhead elements 22, a plurality of tension elements 30 and a plurality of support members 32. The plurality of vertical posts 16 may be made of lightweight material that can be repeatedly bent without fracturing, such as various metallic materials, various impregnated or laminated fibrous materials, various plasticized materials and the like. Each vertical post 16 may terminate at an upper end 46 and an opposite lower end 36. The plurality of overhead elements 22 may be perpendicularly joined to the plurality of upper ends 46 so as to form a generally simple cubic lattice frame 40 defining a watercraft operational envelope. The plurality of tension elements 30 and the plurality of support members 32 may be perpendicularly joined to the plurality of lower ends 36 so as to further form the generally simple cubic lattice frame 40. The dimensions separating the generally parallel elements 22, 30 and each vertical post 16 can vary for sake of defining various watercraft operational envelopes without impacting the functionality of the present invention.

Each cantilever arm assembly 10 may include a first cantilever arm 50 and a cooperating second cantilever arm 52. A horizontal member 54 may perpendicularly join the cantilever arm 50 and to the cooperating second cantilever arm 52 so as to operably interconnect the arms 50, 52. Each cantilever arm 50, 52 may be generally L-shaped, with optional bracing, having a horizontal arm portion 56 and a vertical arm portion 58. The dimensioning of the arm portions 56, 58 may vary within one embodiment and/or between different embodiments of the present invention. Each vertical arm portion 58 may define a vertical housing 60 for slidably securing to an adjacent vertical post 16. In certain embodiments, each vertical housing 60 may include at least a pair of spaced members joined together for slidably receiving the vertical post 16. Each vertical housing 60 may include at least one rotably mounted roller 14. Each at least one roller 14 may be rotably coupled to received vertical post 16 so as to move each cantilever arm assembly 10 from a low position to a raised position, and vice versa, along said vertical post 16. In certain embodiments, the vertical housing 60 may include a pair of opposing mounted sliding units 14.

Each horizontal arm portion 56 may include at least a pair of spaced members joined together joined together so as to form a horizontal housing 62. Each horizontal housing 62 may slidably receive an adjacent extension element 64. Each horizontal housing 62 may be adapted to adjust the length that which the extension element 64 extends from the horizontal housing 62. In certain embodiments, the horizontal housing 62 may have a plurality of spaced apart pin openings 66 along the length thereof to receive an adjustable locator pin or the like on the extension element 64 so as to removably secure the extension element 64 at predetermined lengths relative to the cooperating horizontal housing 62 and/or each other.

On each cantilever arm assembly 10, a cantilever bunk 12 may be pivotably connected to the ends of the cooperating extension elements 64. The cantilever bunk 12 may be adapted in size and dimension to operably engage the bottom surface of various watercrafts when the cantilever arm assemblies 10 move from the low position to the raised position.

Figure 4:
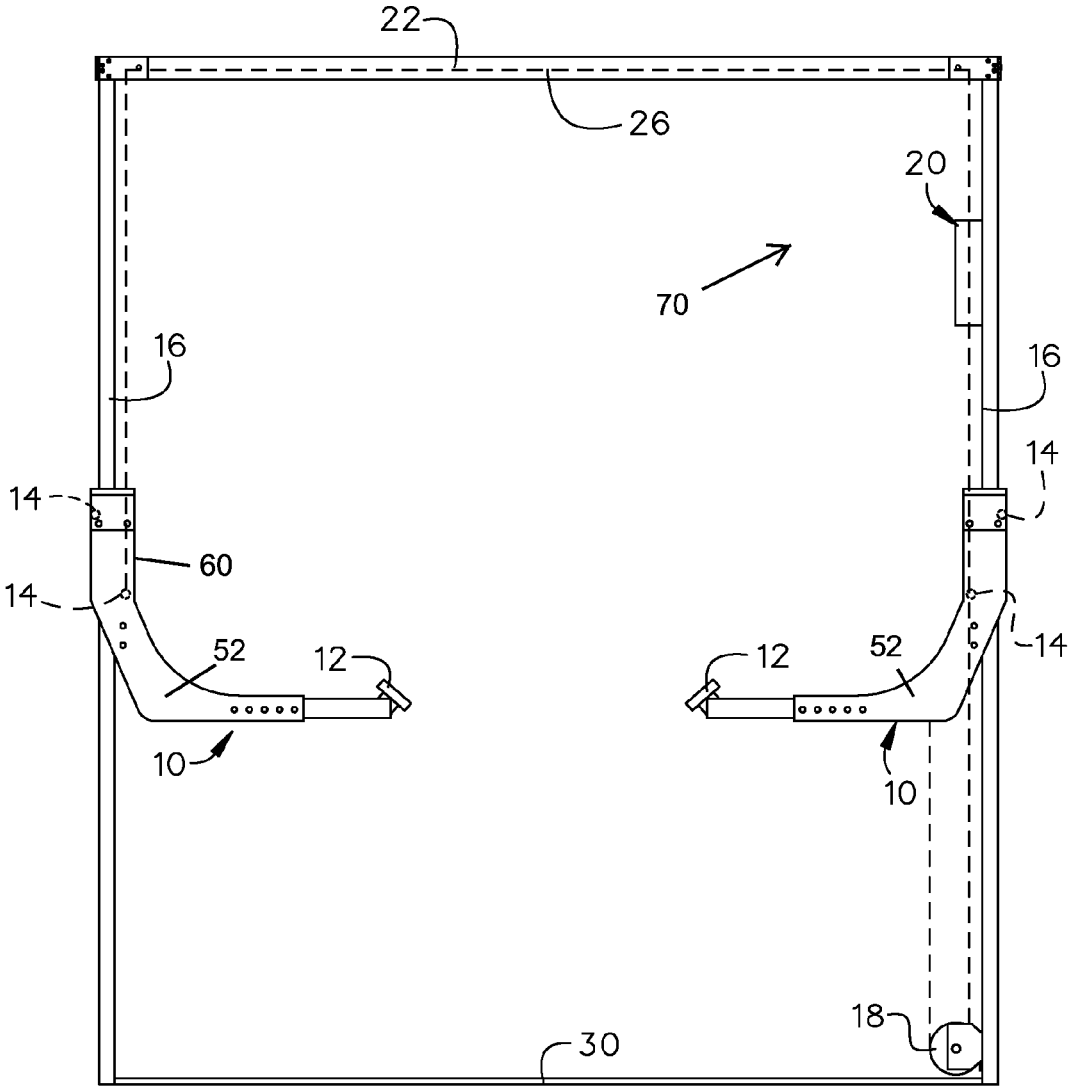
FIG. 4 is a front view of an exemplary embodiment of the present invention.

The lifting system 70 may include a lift cable 26, a cable sheave 18 and a cable box 20. The cable box 20 and the cable sheave 18 may be operably connected to the same vertical post 16 at two different points. The cable box 20 may be adapted to engage the lifting cable 26 so as to provide sufficient lifting power contemplated herein. The lift cable 26 may be affixed to the vertical housing 60 of the cantilever arm 52 of one of the pair of cantilever arm assemblies 10. The lift cable 26 may extend to the upper end 46 of the adjacent vertical post 16 and may extend through a series of cable sheaves so as to be directed horizontally along the adjacent overhead element 22 and directed to descend along the opposing vertical post 16 and through or adjacent to the cable box 20 and then the vertical housing 60 of an opposing first cantilever arm 52 until it extends to and under the cable sheave 18 fixed near the coordinating lower end 36, as illustrated in FIG. 4. Then the lifting cable 26 may be directed upwardly until it reaches and is affixed to the opposing first cantilever arm 52 of the second of the pair of cantilever arm assemblies 10. The lifting system 70 may be adapted to translate the lifting and lowering power of lift-cabled of one of the pair of cantilever arm assemblies 10 to the second of the pair of cantilever arm assemblies 10.

Each leveling cable 24 may be affixed to an adjacent overhead element 22 near the end thereof. Each leveling cable 24 may extend generally vertically downward to and under or through each horizontal member 54 and may be routed through a system of cable sheaves affixed to and horizontally aligned on each horizontal member 54 so that each leveling cable 24 may further extend along the length of each horizontal member 54 and then be directed approximately 90° vertically downward where it is affixed at a point 72 on the support members 32. The leveling cables 24 may be adapted to maintain constant motion between the pair of cantilever arm assemblies 10.

In certain embodiments each cantilever arm assembly 10 may be adapted to rotate within the watercraft operational envelope so that each cantilever bunk 12 rotates to and from the bottom surface of the watercraft so as to eliminate the need to slide the watercraft along the cantilever bunks 12 during operation. For example, each cantilever arm assembly 10 may be rotatably attached to the frame 40 so as to rotate on a translated axis system.

A method of using the present invention may include the following. The watercraft lift assembly 100 disclosed above may be provided. A user may position a watercraft over each cantilever bunk 12 in the low position. Then the user would operate the lifting system 70 so that each cantilever bunk 12 operably engages the bottom surface of the watercraft hull generally with the centerline of the hull being approximately half way between each cantilever bunk 12. As the lifting system 70 moves the cantilever arm assembly 10 from the low position to the raised position, the watercraft would lift to a predetermined height. The user may stat, stop or hold the lift system 70 at the predetermined height within the operating limits so as to allow the operator store the watercraft at the predetermined height for future lowering. In the water, the watercraft lift assembly 100 may raise the watercraft out of the water after use and store above the water level. The watercraft lift assembly 100 may be lowered into the water so the watercraft will float or otherwise can be set to sea.

It should be understood, of course, that the foregoing relates to exemplary embodiments of the invention and that modifications may be made without departing from the spirit and scope of the invention as set forth in the following claims.

What is claimed is:

1. A watercraft lift assembly comprising:

a frame having four vertical posts spaced to define a watercraft operational envelope;

four cantilever arms, one of the four cantilever arms slidably mounted to each vertical post so as to be movable between a low position and a raised position;

four horizontal arm portions, one of the four horizontal arm portions joined to each cantilever arm so that each horizontal arm portion extends along a periphery of the water operational envelope; and two cantilever bunks, each of the two cantilever bunks extending between two of the four horizontal arm portions so that each cantilever bunk dissects the water operational envelope and is in a face-to-face relation with the other of the two cantilever bunks, wherein the two cantilever bunks are disposed at a lowest portion of the four cantilever arms.

2. The watercraft lift assembly of claim 1, wherein each cantilever bunk is pivotably connected to the two horizontal arm portions.

3. The watercraft lift assembly of claim 1, wherein each cantilever arm further comprises:

a vertical arm portion perpendicularly joined to the horizontal arm portion, wherein the vertical arm portion forms a vertical housing slidably receiving each respective vertical post.

4. The watercraft lift assembly of claim 3, wherein each vertical housing includes at least one sliding element coupled to each respective vertical post.

5. The watercraft lift assembly of claim 3, further comprising four extension elements, one of the four extension elements for each horizontal arm portion, wherein each horizontal arm portion slidably receives one of the extension elements.

6. The watercraft lift assembly of claim 5, further comprising two horizontal members, each of the two horizontal members extending between two of the four cantilever arms so that each horizontal member extends along two opposing peripheries of the watercraft operational envelope, wherein each cantilever bunk is pivotably connected to two of the four extension elements.

7. The watercraft lift assembly of claim 6, further including at least one leveling cable affixed to the frame, wherein the at least one leveling cable extends generally vertically downward to and under each horizontal member and then further extending vertically downward so as to affix to the frame.

* * * * *